US009495946B2

(12) United States Patent
D'Addario et al.

(10) Patent No.: US 9,495,946 B2
(45) Date of Patent: Nov. 15, 2016

(54) RATCHETED MOUNTING BRACKET FOR TUNER

(75) Inventors: James D'Addario, Old Westbury, NY (US); Richard N. Steinberger, Nobleboro, ME (US)

(73) Assignee: D'Addario & Company, Inc., Farmingdale, NY (US)

( * ) Notice: Subject to any disclaimer, the term of this patent is extended or adjusted under 35 U.S.C. 154(b) by 184 days.

(21) Appl. No.: 13/593,834

(22) Filed: Aug. 24, 2012

(65) Prior Publication Data

US 2013/0074677 A1 Mar. 28, 2013

Related U.S. Application Data

(60) Provisional application No. 61/626,479, filed on Sep. 27, 2011.

(51) Int. Cl.
*G10G 7/02* (2006.01)
*G10D 3/14* (2006.01)

(52) U.S. Cl.
CPC . *G10G 7/02* (2013.01); *G10D 3/14* (2013.01)

(58) Field of Classification Search
CPC ..... G10D 3/14; G10G 7/02
USPC ..... 84/455, 312 R, 317, 318, 454, 200–209
See application file for complete search history.

(56) References Cited

U.S. PATENT DOCUMENTS

| | | | | |
|---|---|---|---|---|
| 5,492,045 | A * | 2/1996 | Roblee | 84/318 |
| 6,573,440 | B1 * | 6/2003 | Rodriguez | 84/318 |
| 7,939,736 | B2 * | 5/2011 | Campling | G10D 3/043 84/315 |
| 7,968,778 | B2 * | 6/2011 | D'Addario et al. | 84/312 R |
| D661,342 | S * | 6/2012 | Ridinger | D17/99 |
| 2005/0087060 | A1 * | 4/2005 | Taku et al. | 84/455 |
| 2010/0043624 | A1 * | 2/2010 | Nagakura | 84/454 |

* cited by examiner

*Primary Examiner* — Jianchun Qin
(74) *Attorney, Agent, or Firm* — Alix, Yale & Ristas, LLP

(57) ABSTRACT

A bracket for mounting a tuning device on a headstock of a string instrument and a bracket-mountable tuning device are disclosed. A primary arm with a plate attaches to a spring arm with a clamping arm by a releasable ratchet engagement. The clamping arm is reciprocable to the plate. A tuner attaches in a rotatable engagement to the plate opposite a mounting surface. An instrument headstock can be positioned between the plate mounting surface and clamping arm and the clamping arm moved toward the plate to a clamping position with the headstock trapped therebetween with substantially constant pressure on the headstock. The tuner is substantially hidden from the front view of the headstock. The clamping arm is maintained in the clamping position by the ratchet engagement until the ratchet engagement is released.

27 Claims, 7 Drawing Sheets

RATCHETED MOUNTING BRACKET FOR TUNER

CROSS-REFERENCE TO RELATED APPLICATION

This application claims priority from U.S. Provisional Application No. 61/626,479 filed Sep. 27, 2011 for "RATCHETED MOUNTING BRACKET FOR TUNER," the entire disclosure of which is hereby incorporated by reference.

BACKGROUND OF THE DISCLOSURE

The present disclosure relates to a bracket for use with a tuner for a string instrument, and more particularly to a ratchet type bracket for mounting a contact tuner to a string instrument, which requires a minimal number and complexity of components, is easy to install, is operable substantially hidden from view of an audience and promotes convenient use of the tuner.

String instruments, such as guitars and basses, require a variety of maintenance actions, including tuning the strings to a variety of pitches. A number of tuning devices, electronic and otherwise, exist in the field to aid individuals in tuning each string to the desired pitch. Electronic "contact" tuners are commonly configured to be attached at the top of an instrument's headstock protruding outward or above the headstock with a visible display which provides notification of whether the detected pitch of a plucked string is tuned too low (flat), too high (sharp), or proper. Many commercially available tuners are bulky, offer poor aesthetics, are somewhat heavy, and are therefore commonly removed after string tuning is completed, only to have to be re-accessed and attached later. Constant attaching and removing of the tuner is often bothersome and can damage the finish of the instrument by scratching or scuffing. Additionally, some popular string instruments have headstocks that are relatively small near the top and are therefore difficult to attach a conventional tuner to.

Accordingly there is a need in the market for a tuning device for string instruments which is small in size and usable on instruments with a large variety of headstock shapes and sizes, while remaining substantially hidden from view.

SUMMARY

An embodiment of a bracket for mounting a contact tuner on the headstock of a string instrument has a primary arm, a spring arm and a ratchet engagement therebetween. The primary arm has a plate attachable to a contact tuner and defines a first mounting surface for the headstock. A rigid arm extends substantially longitudinally from the plate from the first mounting surface. The spring arm has a post engageable in a variable position with the rigid arm. A clamping arm extends from the post axially spaced from the plate. The ratchet engagement is configured such that when a headstock is placed between the clamping arm and the plate and the clamping arm is pushed toward the plate with the post advancing along the ratchet to a clamping position, the headstock is trapped between the clamping arm and plate with a substantially constant pressure set by the clamping position.

In another embodiment, a tuning device for a string instrument with a headstock has a primary arm, a spring arm and a tuner. The primary arm has a plate defining a first surface configured for mounting on the headstock and a rigid arm extending therefrom. The spring arm is engaged with the primary arm and has a clamping arm extending therefrom. The clamping arm is longitudinally reciprocable toward and away from the plate first surface and releasably maintainable at a plurality of longitudinal positions. The tuner is pivotably attachable to the plate opposite the first surface. When a headstock is positioned between the clamping arm and the primary arm plate and the clamping arm is moved toward the plate to and maintained in a holding position, the headstock is trapped between the clamping arm and plate with a substantially constant pressure.

BRIEF DESCRIPTION OF THE DRAWING

Aspects of the preferred embodiment will be described in reference to the Drawing, where like numerals reflect like elements.

DETAILED DESCRIPTION OF THE PREFERRED EMBODIMENT

Figure 1:
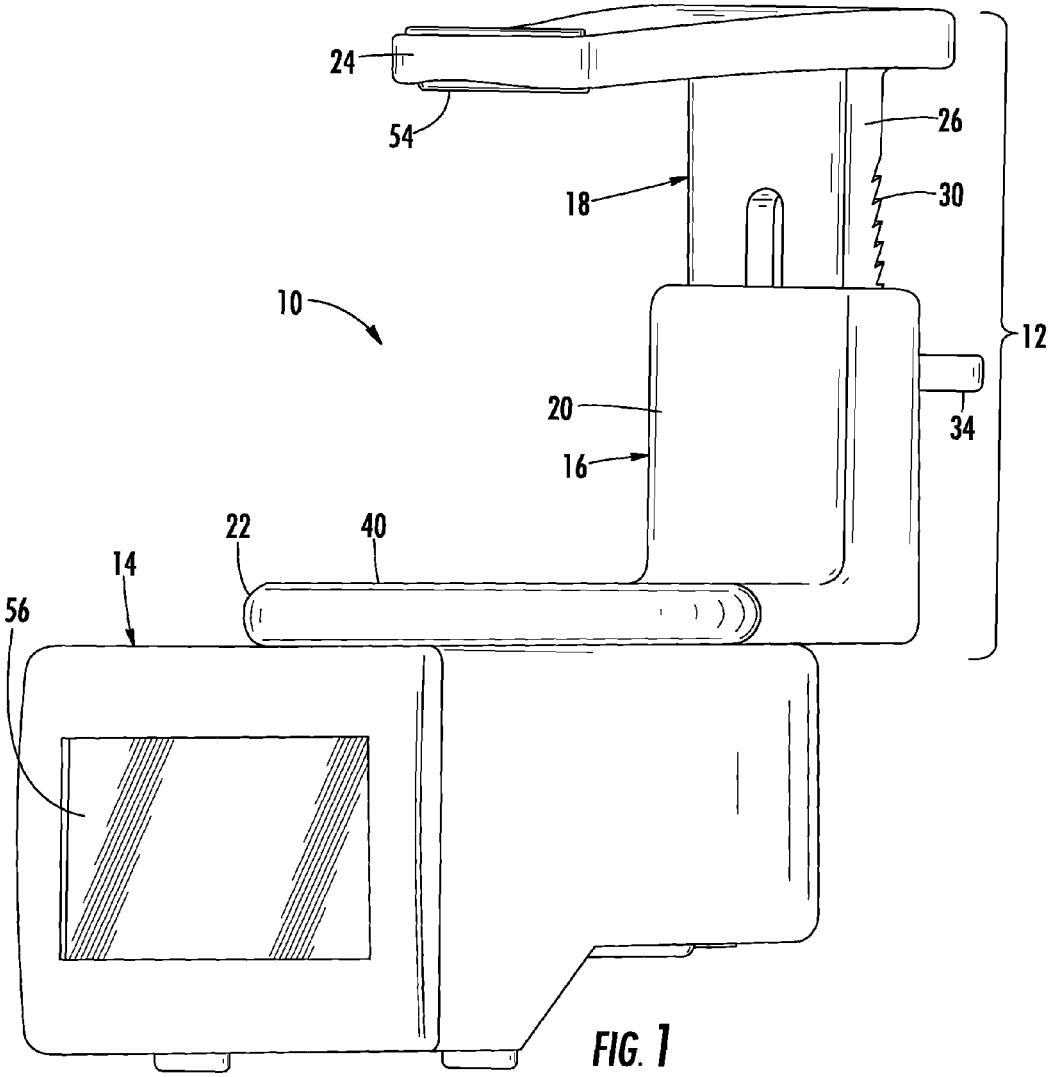
FIG. 1 is a side elevation view of an embodiment of the disclosed ratcheted mounting bracket assembly engaged with an instrument tuner.

With reference to the drawing wherein like numerals represent like parts throughout the Figures, a ratchet mounting device for an instrument tuner and a tuning device are disclosed. Embodiments allow musicians to effectively tune a large variety of string instruments, like guitars and basses of all types, while the tuner remains substantially out of view from the front of the instrument headstock.

In one embodiment, a ratchet mountable tuning device 10 is disclosed. As shown in FIGS. 1-6B, the tuning device 10 includes a bracket assembly 12 removably attached to a tuner 14. As shown, the bracket assembly 12 includes a primary arm 16 and a spring arm 18. The primary arm 16 has a rigid arm 20 extending axially (longitudinally) from a plate 22. In the depicted embodiment, the rigid arm 20 extends vertically at an angle A of approximately 90° relative to a generally horizontal plane P defined by the plate 22 (see FIG. 3). However, this angular relationship is non-limiting, as the angular relationship can be varied as may be appropriate for use with a variety of instruments with different sized and shaped headstocks or with strings and tuning hardware arranged differently.

The spring arm 18 includes a clamping arm 24 which extends from a top portion of a post 26. The spring arm post 26 and the rigid arm 20 are attachable to each other with a ratchet engagement 28. This engagement allows reciprocation between the spring arm 18 and primary arm 16, whereby the clamping arm 24 is axially reciprocated relative to the plate 22. The ratchet engagement 28 allows the post 26 to be generally rigidly maintained at numerous different axial positions relative to the rigid arm 20.

Figure 7:
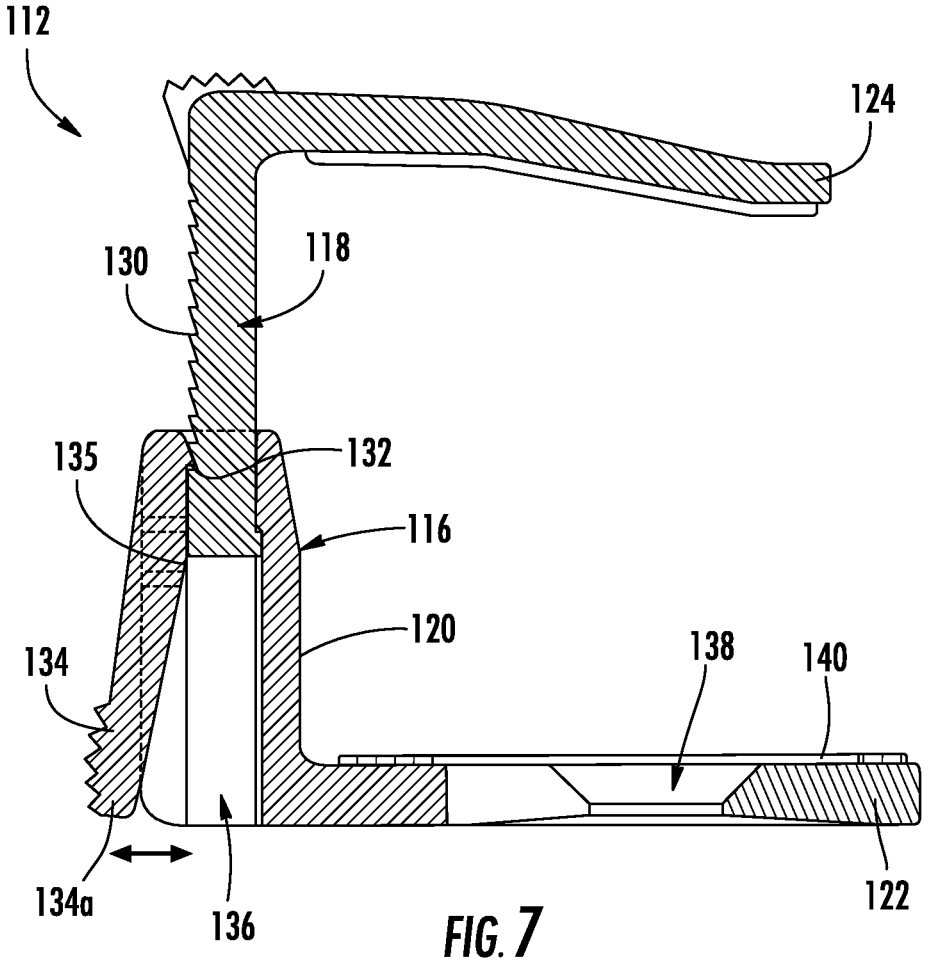
FIG. 7 is a vertical cross section of another embodiment of the inventive bracket assembly.

The depicted preferred embodiment includes a rigid arm 20 that comprises a tubular projection defining an opening 36 generally sized and shaped to receive a portion of the post 26. In this embodiment, the ratchet engagement 28 comprises a plurality of spaced teeth 30 along a rear side of the post 26 engageable with an engagement tooth 32 in the rigid arm 20 which extends slightly into the opening 36. Here, a release lever 34 extends from the engagement tooth 32 to a position rear of the primary arm outer surface. In the depicted embodiment, the lever 34 extends generally laterally from the engagement tooth such that application of pressure on the lever in the longitudinal direction (downward in FIGS. 1-5) disengages the engagement tooth 32 from the spaced teeth 30. The post 26 and rigid arm 20 are then free to reciprocate axially relative to each other until the lever 34 is relieved of pressure, thereby re-engaging the engagement tooth 32 between adjacent spaced teeth 30. The depicted laterally extending lever 34 is simply one preferred ratchet releasing mechanism for use within the disclosed bracket assembly 12. Another embodiment of the ratchet release mechanism is shown in FIG. 7 and will be discussed in detail below. In a preferred embodiment, small bosses 46 at the sides of the spring arm post 26 snap into corresponding groves (not depicted) in the rigid arm 20 to prevent the two parts from separating. A slot 48 in the center of the post allows slight flexibility so the side bosses can move inward slightly during assembly and snap into the rigid arm opening 36. This particular configuration of ratchet engagement 28 is a non-limiting preferred embodiment. For example, embodiments of the disclosed ratchet assembly exist with the depicted configurations of the post and rigid arm reversed.

Figure 2:
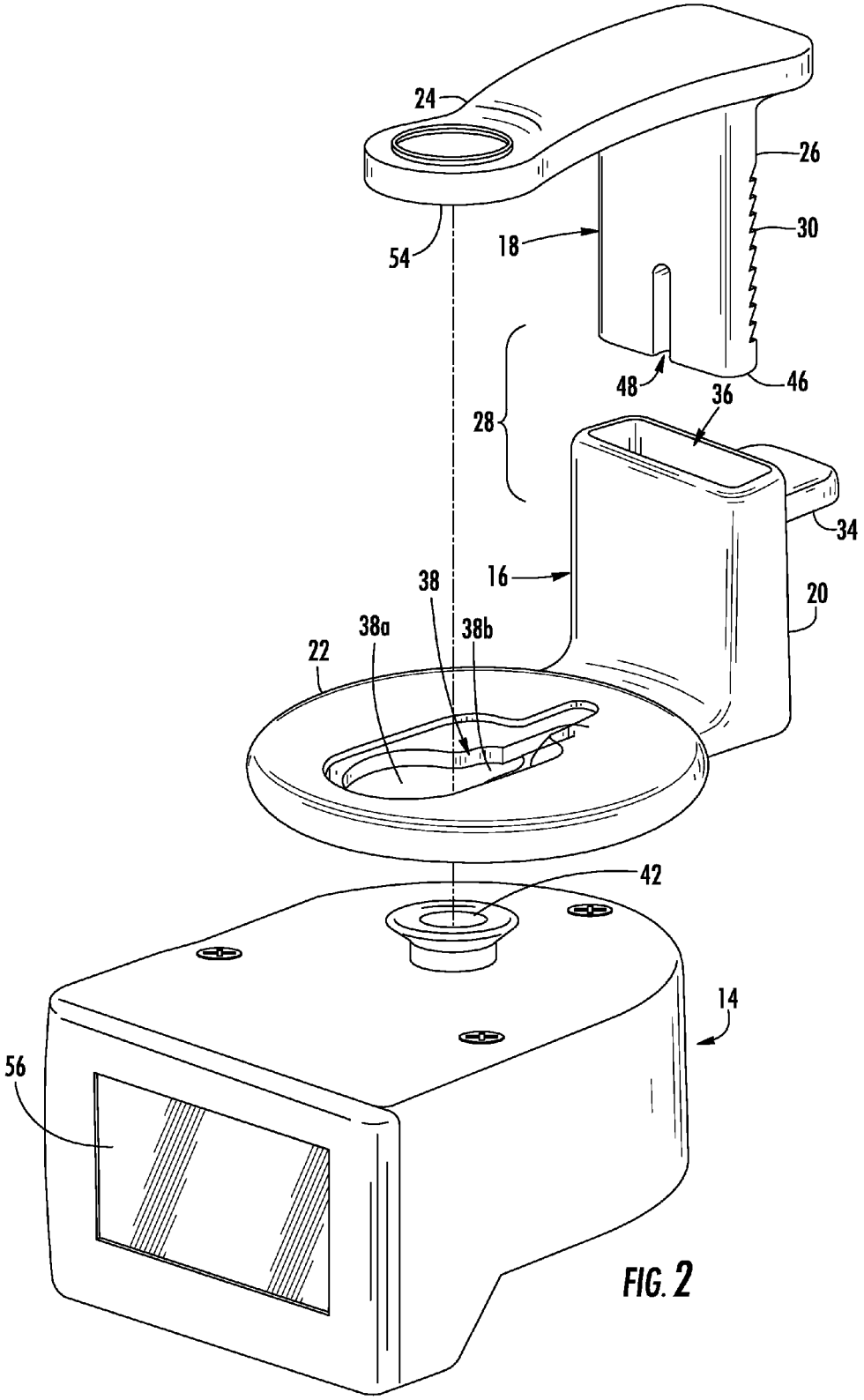
FIG. 2 is an exploded perspective view of the bracket assembly and tuner of FIG. 1.

As depicted most clearly in FIG. 2, the plate 22 has a generally flat contour and defines a slot 38 extending therethrough. In this embodiment, the slot 38 has a general double-lobed shape with an insertion lobe 38*a* having a larger circumference than a retention lobe 38*b*.

Figure 3:
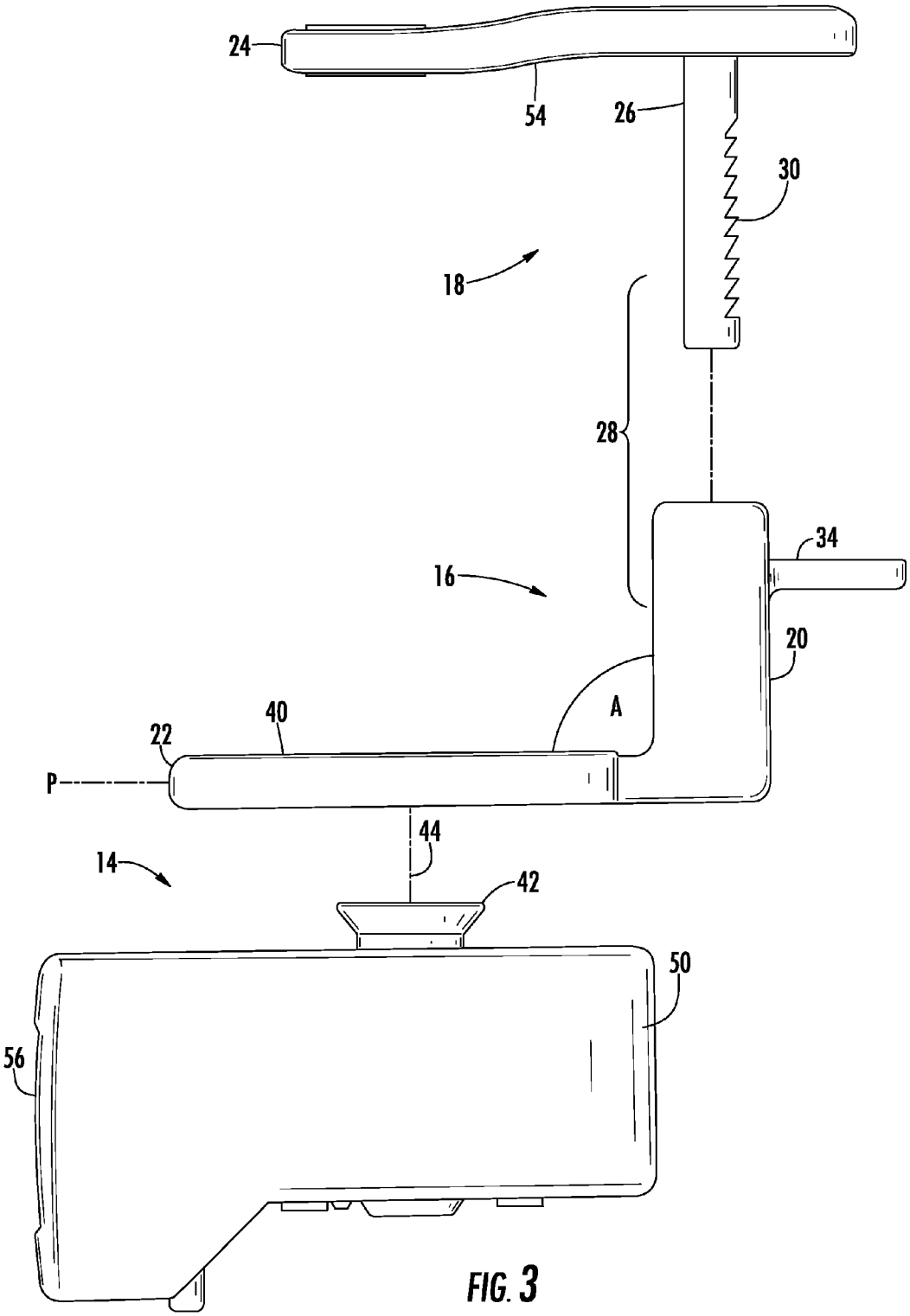
FIG. 3 is an exploded side view of the bracket assembly and tuner of FIGS. 1-2.
Figure 4:
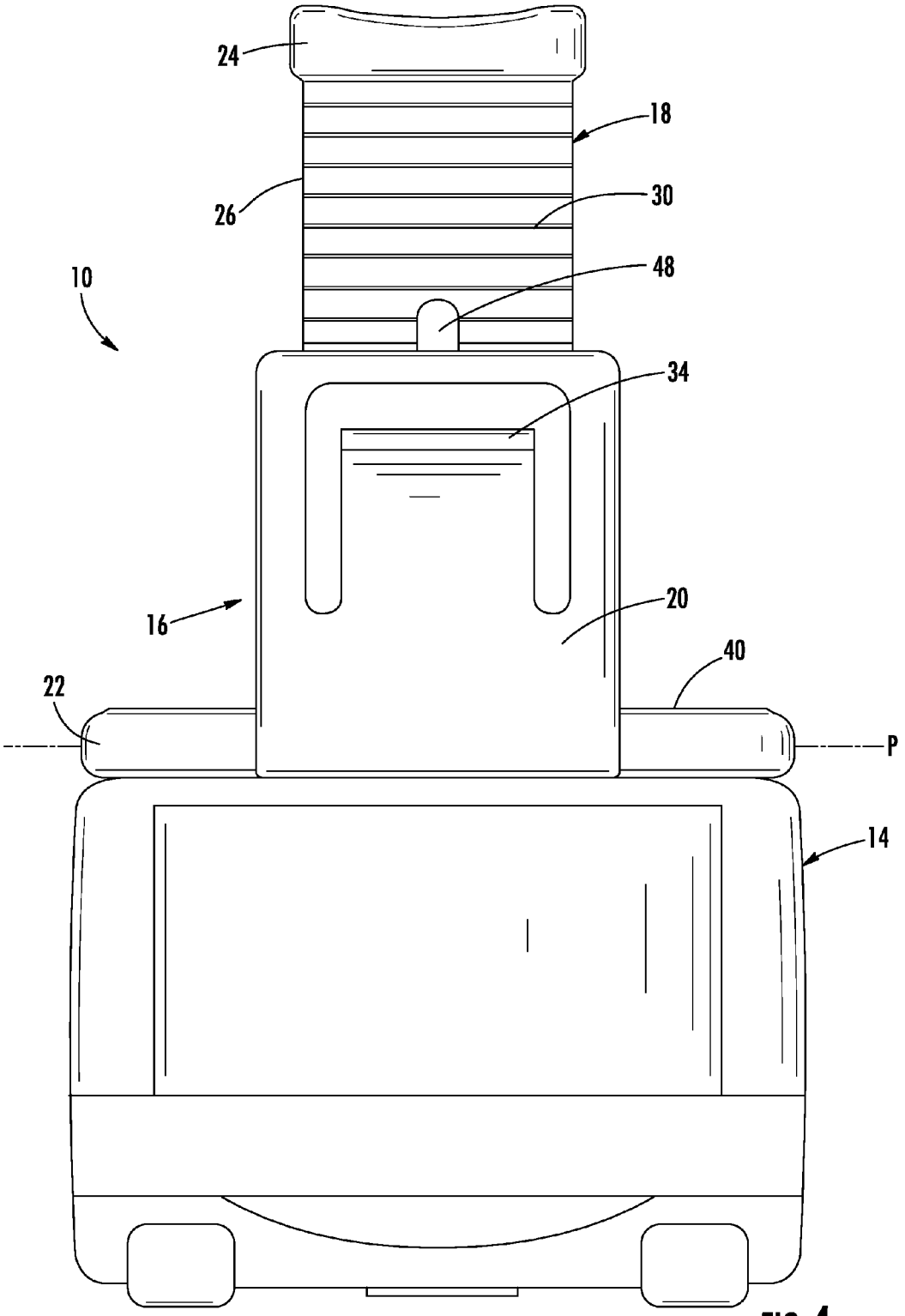
FIG. 4 is a rear view of the bracket of FIGS. 1-3 engaged with an instrument tuner.
Figure 5:
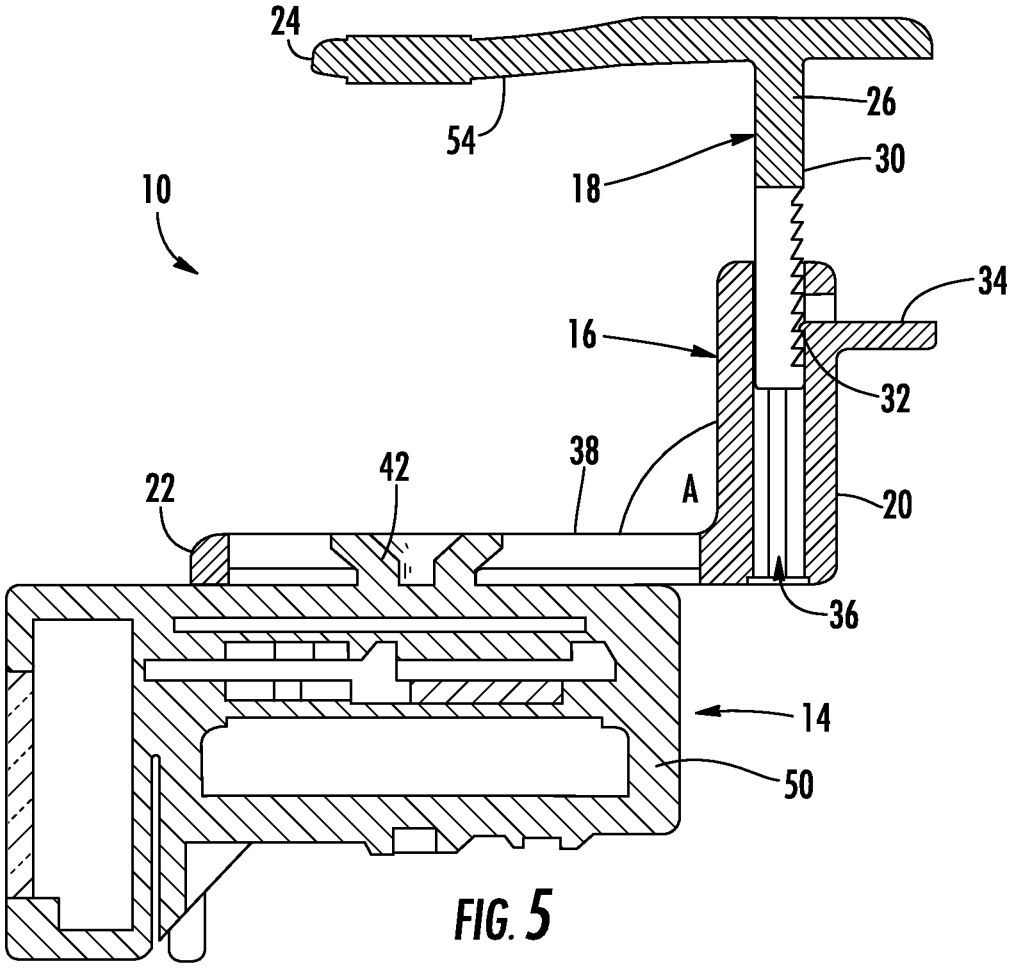
FIG. 5 is a vertical section view of the bracket and tuner engaged, as shown in FIG. 4.

As can be seen, the slot 38 is sized and shaped to receive a generally conical nub 42 defining an axis 44 extending from the tuner housing 50 (see FIG. 3). The slot 38 and nub 42 are preferably configured such that the nub can pass freely through the insertion lobe 38*a* and then be moved or slid to the retention lobe 38*b* where the nub is axially maintained. In one embodiment, the retention lobe 38*b* has a reverse conical contour for general mating with the nub 42. When the nub 42 is maintained in the slot retention lobe 38*b*, the tuner 14 is rotatable about the entire axis 44. The upper surface of the plate is fit with a pad 40 made of a generally compressible material that protects against wearing or scratching a surface, such as rubber. The nub 42 is also preferably sized such that, when maintained within the slot 38, the nub does not extend past at least a portion of the rubber padding 40 on the plate surface (see FIG. 5). As will be discussed in detail below, this arrangement allows the tuner to be rotationally manipulated when the device 10 is clamped to an instrument without risk of damage to the instrument surface.

Figure 6A:
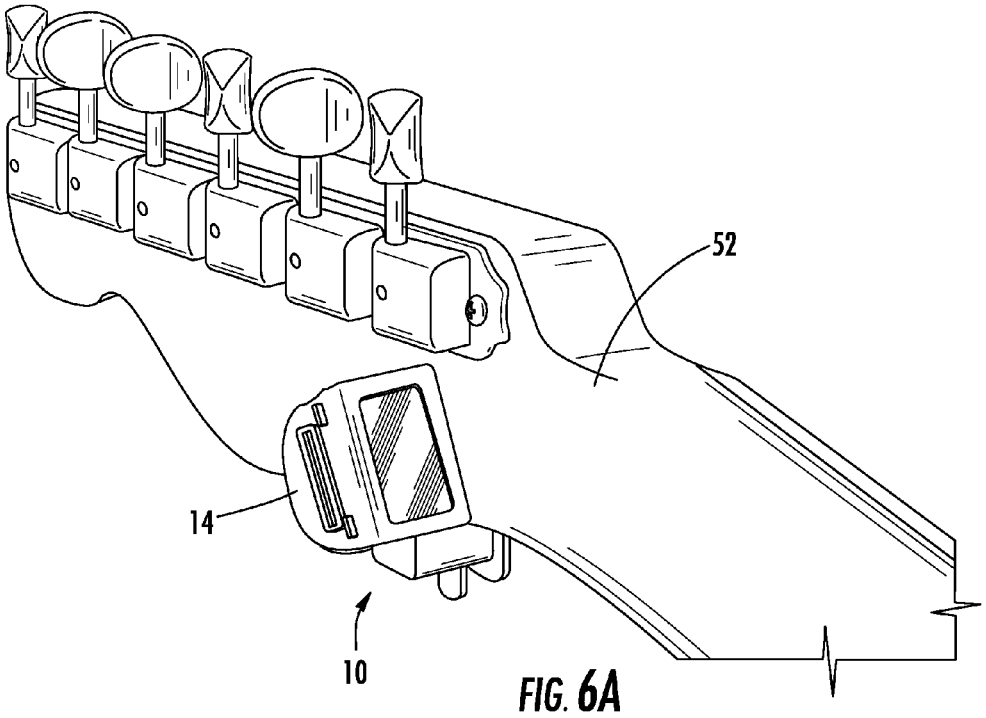
FIG. 6A shows a rear view of the disclosed tuning device attached to the headstock of a string instrument.
Figure 6B:
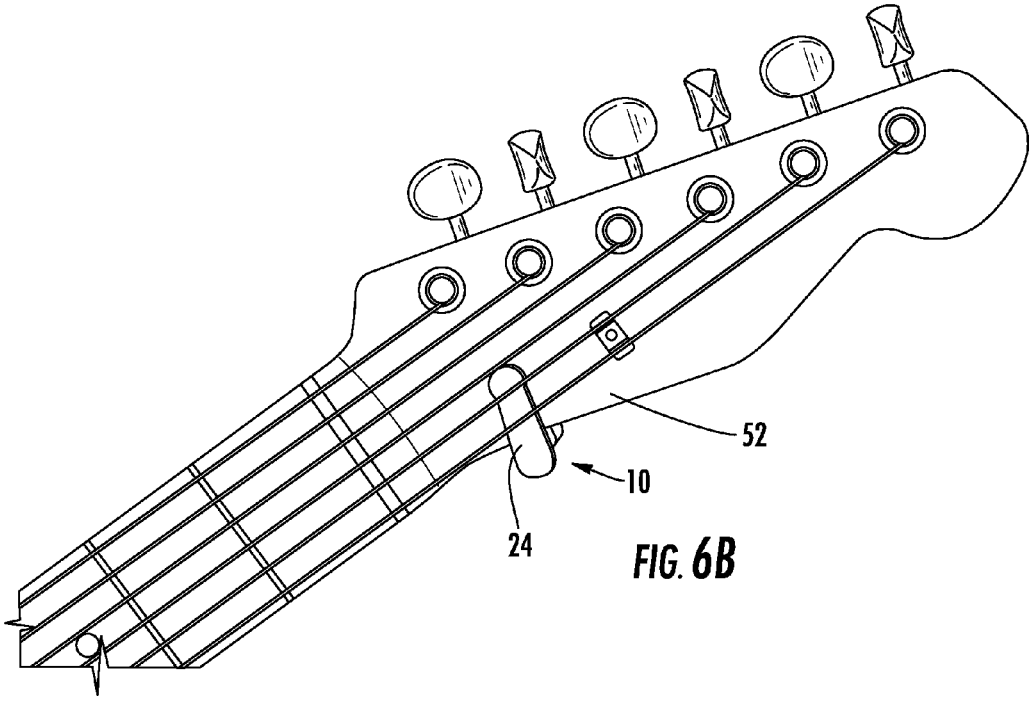
FIG. 6B shows a front view of the depiction of FIG. 6A.

FIGS. 6A and 6B show the tuning device 10 attached to an instrument headstock in a typical manner of operation. The bracket assembly is positioned with headstock 52 between the clamping arm 24 and plate. The plate 22 is preferably positioned on the rear side of the headstock, thereby generally hiding the tuner 14 from frontal view. The ratchet engagement 28 is configured such that the primary arm 16 and spring arm 18 can be pushed together, but not pulled apart without disengaging the engagement tooth 32 from the spaced teeth 30 (via application of pressure on the lever 34). Thus, the spring arm 18 and primary arm 16 are pushed toward each other until the headstock 52 is firmly clamped between the plate 22 and clamping arm 24. The clamping arm 24 is somewhat flexible relative to the post 26, thereby allowing substantially even and constant clamping pressure to be applied to the headstock 52 despite the spacing between the teeth 30 on the post. Like the plate surface, the lower surface of the clamping arm 24 is preferably fit with a resilient pad 54 of rubber or like material. The rubber padding on the plate and clamping arm surfaces provides substantial protection against involuntary movement of the device while clamped or possible scratching or scuffing of the instrument.

As shown in FIGS. 6A and 6B, the bracket assembly 12 allows the tuner 14 to be mounted at the backside of an instrument headstock, and in front of the tuning hardware. The bracket assembly 12 thereby takes full advantage of the headstock itself to hide the tuner 14 out of view of an audience and minimize the visibility of the bracket assembly altogether. Placement of the device in front of the instrument's tuning hardware ensures that the player's view of the tuner display 56 is not interrupted by his hand while manipulating the hardware while tuning the instrument.

When attached to the plate 22, the tuner 14 can be positioned at any rotational position around axis 44, according to the best view of the tuner display 56 when the device 10 is mounted. The engagement between the nub 42 and slot 38 also allows the tuner to be rotated with ease while the device is clamped to the headstock or even removed from the bracket assembly 12 while the headstock remains clamped between the clamping arm 24 and plate 22.

FIG. 7 depicts an alternative embodiment of the bracket assembly 112 for attachment of a tuner to an instrument headstock (not depicted). This embodiment operates much like the embodiment shown in FIGS. 1-6B, however utilizing an alternative ratchet release mechanism and lever 134. The primary arm 116 includes a generally flat plate 122 defining a slot 138 extending therethrough. The slot 138 is configured to receive and retain a nub in a tuner just as the slot 38 in the previous embodiment. Also included in the primary arm 116 is a rigid arm 120 extending from the plate 122 and defining an opening 136.

The opening 136 is configured for receipt of the post 118 of the spring arm. Extending from the post 118 is the clamping arm 124 configured for clamping to an instrument headstock. Like the previous embodiment, the post 118 includes a plurality of spaced teeth 130 which engage the primary arm 116 via engagement tooth 132. Extending from the engagement tooth 132 is the release lever 134. This embodiment of release lever 134 extends obliquely from the primary arm 116, rather than generally laterally. The bracket assembly 112 is operated to clamp a headstock between the clamping arm 124 and plate 122 (having a resilient pad 140) substantially as described above with reference to the bracket assembly 12. However, here, disengagement of the teeth 130 from the engagement tooth 132 is effected by pressing or pinching the lever distal end 134*a* toward the plate. As depicted, the lever 134 pivots at position 135, thereby releasing the engagement tooth 132 from the ratchet engagement with the teeth 130. The post 118 can be reciprocated within the opening 136 to loosen a clamp when the engagement tooth 132 is disengaged from the spaced teeth 130. Releasing pressure from the lever distal end 134*a* returns the engagement tooth 132 to its original position extending slightly within the opening 136. The engagement tooth 132 can be biased toward the teeth 130 by an appropriately configured and positioned helical spring or like element (not depicted). Alternatively, the lever 134 and engagement tooth 132 can be reciprocable simply due to flexibility of the manufacturing material, such as a polymer. The bracket assembly 112 is operated to releasably attach a tuner to an instrument headstock substantially as shown in FIGS. 6A and 6B and described above with reference to the previous embodiment.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. A bracket for mounting a contact tuner on the headstock of a string instrument, comprising:

a primary arm having a plate defining a first mounting surface for the headstock and an opposite second outer surface, the plate being attachable to a contact tuner to define the attached position, and a rigid arm extending from the plate substantially longitudinally from the first mounting surface;

a spring arm having a post engageable with the rigid arm in a variable position, and an integrated clamping arm extending from the post axially spaced from the plate, the clamping arm is flexible relative to the post; and a releasable ratchet engagement between the post and rigid arm, whereby when a headstock is placed between the clamping arm and the plate and the clamping arm is pushed toward the plate with the post advancing along the ratchet to a clamping position with the headstock trapped between the clamping arm and the plate, the clamping arm flexes relative to the post, thereby trapping the headstock against the plate with a substantially constant pressure.

2. The bracket of claim 1, wherein the rigid arm comprises a tubular projection defining an opening sized and shaped to receive a portion of the spring arm.

3. The bracket of claim 1, wherein the releasable ratchet engagement includes a plurality of spaced apart teeth on the spring arm configured to mate with an engagement tooth in the rigid arm.

4. The bracket of claim 3, comprising a lever extending generally laterally from the engagement tooth opposite the plurality of teeth, whereby substantially longitudinal pressure on the lever disengages the engagement tooth from one of the plurality of spaced teeth to allow reciprocation of the spring arm.

5. The bracket of claim 1, wherein the plate defines a slot extending therethrough being sized and shaped to receive and retain a nub extending from the tuner for attachment of the tuner and plate.

6. The bracket of claim 5, wherein the nub defines the axis about which the tuner is rotatable relative to the bracket when attached.

7. The bracket of claim 5, wherein the nub is positioned axially beneath the plate mounting surface when the tuner and plate are attached, thereby concealing the nub from contact with the headstock surface in the clamping position.

8. The bracket of claim 5, wherein the plate slot has a first lobe with a first diameter that transitions to a second lobe with a second diameter that is smaller than the first diameter.

9. The bracket of claim 8, wherein the tuner nub is sized and shaped to pass freely through the first lobe while not being capable of passing through the second lobe.

10. The bracket of claim 1, wherein the tuner is rotatable 360° relative to the plate in the attached position.

11. The bracket of claim 1, wherein the second outer surface of the plate defines a plane and the tuner has an outer surface with a substantially flat portion that contacts the second plate outer surface in a substantially face-to-face abutment in the attached position.

12. The bracket of claim 11, wherein the tuner is rotatable relative to the plate about an axis that is substantially perpendicular to the plane in the attached position.

13. A tuning device for use with a string instrument having a headstock, comprising:

a primary arm having a plate defining a first surface configured to mount on the headstock and an opposite second surface, and a rigid arm extending therefrom;

a spring arm engaged with the primary arm and having a clamping arm extending therefrom being longitudinally reciprocable toward and away from the plate first surface and releasably maintainable at a plurality of longitudinal positions;

a tuner attached to the plate opposite the first surface, the tuner being pivotable relative to the plate; wherein when an instrument headstock is positioned between the clamping arm and the primary arm plate and the clamping arm is moved toward the plate to and maintained in a holding position, the clamping arm flexes in the direction away from the plate, thereby trapping the headstock against the plate with a substantially constant pressure.

14. The tuning device of claim 13, comprising a releasable ratchet engagement between the spring arm and rigid arm.

15. The tuning device of claim 14, wherein the releasable ratchet engagement includes a plurality of spaced apart teeth on a post in the spring arm configured to mate with an engagement tooth in the rigid arm.

16. The tuning device of claim 15, comprising a lever extending from the engagement tooth opposite the plurality of teeth, whereby substantially pressure applied on the lever disengages the engagement tooth from one of the plurality of spaced teeth.

17. The tuning device of claim 15, comprising a lever extending from the engagement tooth opposite the plurality of teeth generally obliquely from the rigid arm, whereby pressure on the lever toward the rigid arm disengages the engagement tooth from one of the plurality of spaced teeth.

18. The tuning device of claim 13, wherein clamping arm defines a clamping surface facing the plate first surface, and the first and clamping surfaces each have a resilient pad.

19. The tuning device of claim 13, wherein the rigid arm comprises a tubular projection defining an opening sized and shaped to maintain a post in the spring arm.

20. The tuning device of claim 13, wherein the plate defines a slot extending therethrough shaped for receipt of a nub extending from a surface of the tuner for attachment of the tuner and plate, the nub defining a rotational axis about which the tuner is rotatable relative to the primary arm and spring arm when attached.

21. The bracket of claim 20, wherein the plate slot has a first lobe with a first diameter that transitions to a second lobe with a second diameter that is smaller than the first diameter, the second lobe being sized to prevent the tuner nub from passing therethrough.

22. The tuning device of claim 13, wherein the tuner is rotatable 360° relative to the plate.

23. The tuning device of claim 13, wherein the plate second surface has a substantially flat face and the tuner has an outer surface with a substantially flat face that abuts the plate second surface face in a face-to-face relationship.

24. The tuning device of claim 23, wherein the plate defines a plane and the tuner is pivotable about an axis that is substantially perpendicular to the plane.

25. A tuning device for use with a string instrument having a headstock, comprising:

a primary arm having a plate with a first mounting surface for the headstock on a first side and a contact surface on a second side opposite the first side;

a spring arm having a rigid post engaged with the primary arm and having a clamping arm extending therefrom with a second mounting surface facing the first mounding surface, the spring arm being longitudinally reciprocable toward and away from the first mounting surface and releasably maintainable at a plurality of longitudinal positions;

a tuner attached to the plate disposed on the plate second side, wherein when the instrument headstock is positioned between the clamping arm and the plate and the clamping arm is moved toward the plate with the second mounting surface against the headstock while the headstock contacts the first mounting surface, the second mounting surface moves relative to the post to accommodate and maintain the headstock in a holding position with the headstock trapped between the clamping arm and the plate with a substantially constant pressure.

26. The tuning device of claim 25, wherein the contact surface of the plate is substantially flat and the tuner defines an outer surface with a substantially flat portion that abuts the substantially flat portion of the plate in a face-to-face relationship.

27. The tuning device of claim 26, wherein the plate defines a plane and the tuner is rotatable relative to the plate about an axis that is substantially perpendicular to the plane.

* * * * *